United States Patent [19]

Oberg et al.

[11] 4,251,318

[45] Feb. 17, 1981

[54] METHOD OF MAKING FULLY ETCHED TYPE-CARRIER ELEMENTS

[75] Inventors: Gary Oberg, Darwin; Gerald F. Wocken, Hutchinson; Daniel E. Huntwork, Hutchinson; Wayne M. Fortun, Hutchinson, all of Minn.

[73] Assignee: Hutchinson Industrial Corporation, Hutchinson, Minn.

[21] Appl. No.: 53,410

[22] Filed: Jun. 29, 1979

[51] Int. Cl.[3] ..... B41J 1/16; B41J 1/26; C23F 1/04

[52] U.S. Cl. ..... 156/645; 101/93.19; 156/651; 156/661.1; 156/664; 400/144.2; 430/320; 430/323; 430/327

[58] Field of Search ..... 400/144.2, 144.3, 144.4, 400/174; 101/93.19; 156/661.1, 659.1, 651, 664, 645; 430/318, 320, 323, 327

[56] References Cited

U.S. PATENT DOCUMENTS

| | | | |
|---|---|---|---|
| 2,888,335 | 5/1959 | Atkins et al. | 430/323 |
| 2,940,838 | 6/1960 | Snyder et al. | 156/659.1 |
| 3,726,732 | 4/1973 | Richardson | 156/651 |
| 4,021,276 | 5/1977 | Cho et al. | 156/661.1 |
| 4,037,707 | 7/1977 | Ku et al. | 400/174 |
| 4,040,891 | 8/1977 | Chang et al. | 430/323 |
| 4,070,752 | 1/1978 | Robinson | 156/645 |
| 4,102,735 | 7/1978 | Weglin | 156/661.1 |
| 4,105,341 | 8/1978 | Chivens et al. | 400/144.2 |
| 4,105,493 | 8/1978 | Chauvy | 430/320 |
| 4,127,336 | 11/1978 | Hiroaka et al. | 400/144.2 |

*Primary Examiner*—Jerome W. Massie

*Attorney, Agent, or Firm*—Schroeder, Siegfried, Ryan, Vidas, Steffey & Arrett

[57] ABSTRACT

Etched one-piece type-carrier elements.

9 Claims, 14 Drawing Figures

METHOD OF MAKING FULLY ETCHED TYPE-CARRIER ELEMENTS

DESCRIPTION

Background of Prior Art

This invention relates to impact printers and specifically to the type character carrying elements, print-carrier or type-carrier elements used in impact printers. The invention is concerned with a new and improved type-carrier element as an article of manufacture and with methods of making the same.

In impact printers, there is typically utilized a rotatable print disc, barrel, thimble, or the like comprising a type-carrier element and a hub mounting arrangement. The type-carrier element has a plurality of flexible spaced-apart radially-distributed finger or arm members with print characters thereon. These arms are disposed at angular increments around a center portion which is designated to be rotatably mounted in the impact printer. The print carrying arms are positioned in the printer so as to be generally parallel to the plane of a surface which is to receive the printing such as a sheet of paper. To print any desired character, the type-carrier element is rotated by a driving mechanism in the printer to a position corresponding to the selected print character on one of the arms. The character is then printed by hammering the arm into contact with an inked ribbon and against the paper.

The rotatable type-carrier element may, as indicated above, take various forms such as discs, barrels, thimbles, and the like. One of the more popular forms is the planar disc-shaped element used in the print disc commonly referred to as the "daisy wheel". Another is referred to as a "thimble" because of its thimble-like appearance in which a center portion carries the spaced arms extending generally upwardly therefrom. Herein, all of these various types and styles of carrier elements are recognized as including a center portion having a plurality of arms extending peripherally therefrom, whether in the same plane as the center portion or angularly thereto. Such elements are referred to collectively herein as print-carrier or type-carrier elements. In use, the element itself consisting of the center portion and radially extending arms may be fitted with various kinds of hub fittings and the like for rotatably mounting the element, indexing it, and so forth. The arms may be formed or bent, after fabrication of the element, to adapt it to various printers. The present invention is specifically concerned with the type-carrier element itself and its fabrication.

Typical prior art type-carrier elements may make use of type characters or type slugs which are integrally molded at the ends of the arms. Various portions of the carrier elements, sometimes both the arms and the type or print character slugs, may be made of thermoplastic materials. In some of the prior art elements, the arms are formed from metal and the character slugs are molded plastic formed on or attached to the arm ends. The slugs carry the type characters for printing and are sometimes covered with a metallized surface coating for increased life. Metal slugs have also been used by welding them to the arm ends individually. Composite structures of plastic and metal suffer from relatively short life. Typical problems due to the use of plastics are arm breakage and character face degradation. Welded carrier elements formed completely of metal have not been used successfully because of their relatively high weight and high inertia. Elements without integral hubs are difficult to align during assembly unless expensive and complicated fixtures are used.

It is an object of this invention to provide rotatable metal print-carrier elements of one piece, having integrally formed print characters thereon.

It is another object of this invention to provide flat, thin type-carrier elements which possess extended useful life.

It is another object of the invention to provide all-metal print-carrier elements of low inertia and low weight.

It is another object of this invention to provide an all-metal type-carrier element with integral alignment means for simple, accurate, economical assembly to a hub fitting.

It is also an object of the invention to provide a method of making such type-carrier elements, particularly by a method wherein both the arms and type elements are a one-piece element of metal, made in such a manner as to avoid having residual stresses therein.

These and other objects of the invention will become more apparent from the description hereinbelow which sets forth a method of making type-carrier elements wherein a positive photoresist material is used.

BRIEF SUMMARY OF THE INVENTION

This invention provides a metal, one-piece type-carrier element with integrally formed type characters on the extending arms thereof. It is formed by chemical milling, as by etching. Hereinafter, the term "etching" shall be taken to mean all equivalent "chemical milling" techniques.

Preferably, type-carrier elements of the invention will be made from metals which are initially relatively soft (annealed for example) both for forming purposes and because of their inherent freedom from internal stress. These metals are hardenable at a subsequent stage of manufacture. The metal must be hardened to provide the impact, abrasion and fatigue resistance required in these elements. Hardening some metals causes residual stress formation resulting in elements which are warped or which are not flat. For example, martensitic metals such as 410 stainless do this. Hardening of such metals is usually accomplished by work hardening, cold rolling, drawing or transformation hardening. To use such metals with this invention, residual stresses must be removed following hardening.

Fortunately, precipitation hardenable metals such as 17-7 stainless may be hardened with much lower residual stress formation. For that reason, such metals are especially preferred for use with this invention. Such metals allow the use of thinner initial stock than do the other metals. Additional features of the invention and advantages thereof lie in the preferred use of a two-stage character etch for sharp definition, completion of all image formation (printing) in the photoresist before initiation of any etching through the use of positive photoresist and the use of patterns for character image formation which include both locator holes and print or type characters to provide precise registration of the type characters with the hub assembly fixture when the elements are assembled with hubs. Locator holes assure alignment of the type characters with pins on the fixture which are used in fastening print elements to hubs.

DETAILED DESCRIPTION OF THE INVENTION

Figure 14:
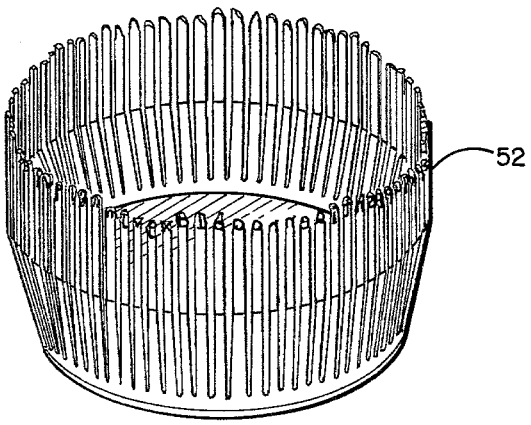
FIG. 14 is a pictorial presentation of a unitary thimble or barrel shaped print-carrier element made from one piece of metal and etched and formed according to the invention.

As previously pointed out, this invention is concerned with type-carrier elements which may assume various configurations and shapes. The preferred print-carrier element configuration is the flat planar disc configuration used in the "daisy wheel" printer and in which a center portion is provided with radially extending flexible arms. However, as shown in FIG. 14, the print-carrier elements of the invention may also be provided in other shapes. For clarity and simplicity, the invention will be described herein in connection with the preferred configuration i.e., a planar-like disc. It is to be understood that the type-carrier elements described herein will, in use, be fitted with various hub-like structures and the like for accommodating them to an operating servomechanism and mounting means in an impact printer, such as the common office typewriter, teletypewriter, low-speed computer output printer, and the like. Such matters will be obvious to those of ordinary skill in the art and need not be described in detail herein as the invention is specifically concerned with the print or type-carrier element per se and its method of manufacture.

Figure 1:
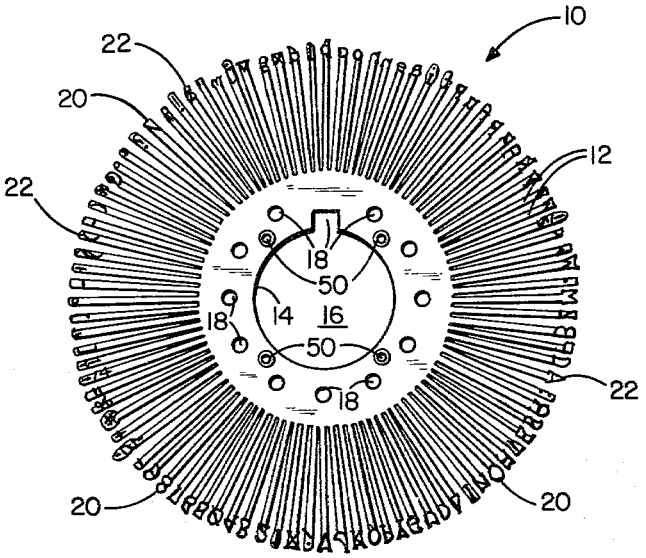
FIG. 1 is a top plan view of a type-carrier element according to the invention.
Figure 2:
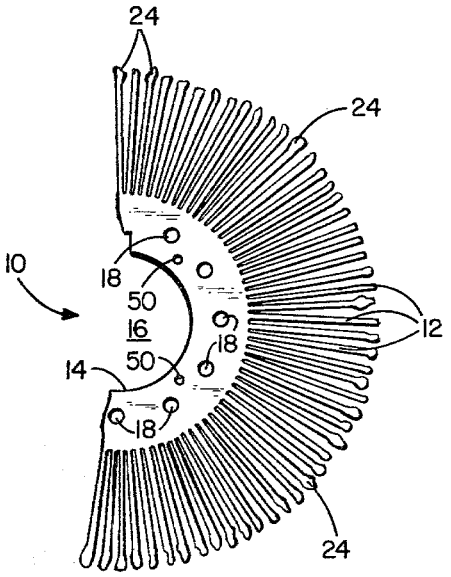
FIG. 2 is a bottom plan view of a fragment of the type-carrier element of FIG. 1.

As shown in FIGS. 1 and 2, the preferred type-carrier element of the invention is a planar-like or substantially flat disc-like element of unitary or one-piece construction which is made of metal. The element is identified at 10. A preferred metal for element 10 is 17-7PH stainless steel for reasons to be described in detail hereinbelow. However, other metals may also be used so long as they can be chemically milled, as by etching. For example, 410 stainless steel, 302 stainless steel, or beryllium-copper alloys, such as Type CA172, may be used.

As is seen in the Figures, carrier element 10 has a plurality of arms 12, sometimes referred to as fingers or beams, extending radially outward from a flat center portion 14. Arms 12, being flat thin metal, are flexible. However, flexible arms of other cross-sectional configuration may be used. For example an I-beam cross-section, which will not only reduce inertia but provide resonance damping, may be used. All such variations are within the scope of this invention. Center portion 14 may assume various configurations depending on the type of mounting and indexing mechanism with which it is to be used. It will typically, as shown, have a center opening 16, a plurality of apertures 18 of various styles and configurations and locating holes 50 distributed therein. Locating holes 50 are formed from the same master artwork or pattern as the type characters to assure precise registration of the type with respect to a hub assembly fixture. Openings 16 and 18 are formed in conventional manner from the master artwork that defines the overall shape of the element. However, fabrication tolerances prevent features etched from the back side of the element from being used for alignment of the type characters.

At the outer ends of each arm on the upper surface thereof, as shown in the top plan view of FIG. 1, there are print or type receiving surface areas 20 having integrally formed type characters 22 thereon in relief. As is typical in the art, any configuration and style of type characters may be selected to provide collectively on the element any desired type font.

The lower surface of the outer ends of arms 12, as shown in the bottom plan view of FIG. 2, comprise impact surfaces 24 against which a printer hammer (not shown) strikes when the element is in use for printing. As is evident, striking the impact surface of any particular arm 12 will deflect the arm, allowing the type character 22 thereon to be pressed against a contacting surface or platen for causing imprint. The platen often is cylindrical. The face of the type element may be curved to match closely the diameter of the platen. It is to be noted that the impact surfaces 24 vary in outline shape. In the interest of minimizing the inertia of the element, particularly at the outer ends of arms 12, unneeded metal is preferably removed in so far as possible. Other areas from which metal may be removed by etching are the open areas within the outline of each character. Such open areas in the characters, for example the central portion in the letter "O", will additionally provide self-cleaning characters. Such variations are within the scope of this invention. Consequently, the outer ends of arms 12 may assume shapes which are somewhat like the print characters 22 carried on each of the printing surfaces 20.

A unitary or one-piece all-metal print-carrier element of the type shown in FIGS. 1 and 2 will preferably have a thickness in the range of about 5 to 15 mils except at character locations and will consequently have low inertia, light weight, and extended printing life. This is very important in high-speed impact printers where the element is rotated with high angular acceleration and repeatedly hammered, causing deflection of the arms and compression of the characters.

Referring now to FIGS. 3–13, one version of the preferred method of fabricating print-carrier element 10 is described in detail. In this particular instance, the final print-carrier element 10 will preferably have an overall thickness of about 5 to 15 mils, 9 mils being most preferred when 17-7PH stainless is used. The preferred thickness represents a satisfactory balance of reduced amplitude of vibration without excessive stress levels due to deflection, i.e., an optimum combination of stiffness and fatigue life. At the outer ends of arms 12 the thickness will be approximately 15 to 25 mils, 19 mils being preferred when 17-7PH stainless is used, including the dimensions of the raised type characters which are formed in relief thereon. Consequently, the metal sheet from which element 10 is to be formed will in the preferred instance be initially about 15 to 25 mils thick, most preferably about 19 mils when 17-7PH stainless is used.

As previously indicated, those metals are preferred for this invention which are heat treatment or precipitation hardenable, as 17-7PH stainless steel is. Such metals when heat treated, are relatively free of surface stresses and do not cause bowing in the final product. Also, workpieces of such metals can be preliminarily worked in the annealed condition, i.e., condition "A", as by coining or the like and then transformation or precipitation hardened prior to etching.

Other types of metals which are not free of surface stresses, e.g., cold rolled 410 stainless, must be subjected to removal of certain amounts of metal from the surfaces thereof in order to obtain a relatively stress-free workpiece. This is not necessary with the precipitation hardenable metals, e.g., the 177PH. Consequently, one can begin with a thinner gage stock when using the precipitation hardenable type. It should be noted however, that the other metals may be utilized in this invention after being treated to remove surface stresses, as by the surface trimming etching described above.

Broadly, what is described hereinbelow is a preferred etching technique for forming type-carrier element 10. It is to be understood that this represents a preferred embodiment as presently conceived by the inventors. However, variations thereof may be used. The technique described employs a positive photoresist material of the type which when exposed to light may be removed by use of appropriate solvents. One photoresist material of this type is known as Shipley AZ-111. A typical developer or solvent therefor is Shipley AZ-303. Both are available from Shipley Co., Inc., (2300) Washington Street, Newton, Massachusetts (02162.)

The use of the positive resist allows the printing of multiple images, i.e., first and second stage characters i.e., slightly enlarged and more sharply defined, respectively, and multiple etching thereof, resulting in more sharply defined images. Also, all printing may be completed before etching is initiated.

Any commercially available etchant may be used, such as ferric chloride compositions which are well known in the art. Etching from both sides, either simultaneously or sequentially, may be used.

Figure 3:
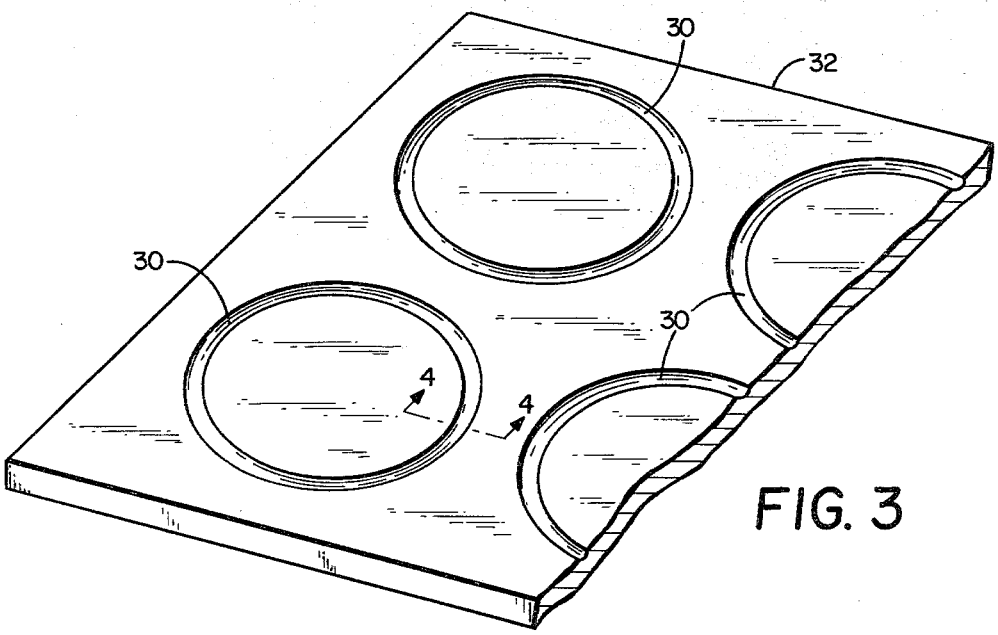
FIG. 3 is a schematic perspective view in fragment of a metal sheet in initial manufacturing stages for producing a type-carrier element of the type shown in FIG. 1.

As can be seen from FIG. 3, the metal sheet 32, from which the type-carrier elements are to be fabricated, may contain many carrier elements. Preferably, the sheet will have an initial thickness of about 19 mils. For economy in production, it is assumed that a plurality of elements will be made from single large sheets. However, for clarity and description, the fabrication of only a single element will be described.

Figure 4:
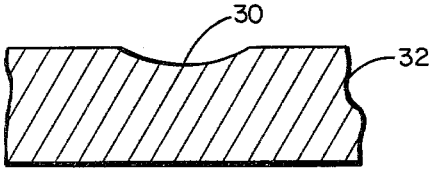
FIG. 4 is a fragmentary cross-section view taken along lines 4—4 of FIG. 3.

The first step in fabrication may consist of a forming operation in which a concave ring-like area 30 is formed in the front surface or one side of sheet 32. Concave area 30 is ring shaped as shown, and corresponds to an area on the outer diameter of each type-carrier element 10 on the sheet thus including within its concave area the printing surface area portions 20 at the outer ends of arms 12 of the element. The concave area 30 will be shaped as shown in FIG. 4 so as to conform to the curvature of the platen with which the print-carrier element is to be used. One metal deformation technique which may be used for forming surface 30 is coining. However, any other metal working technique, such as grinding, machining, embossing, etc., may be used for this purpose as will be apparent to those of ordinary skill in the art. In some cases, no curvature will be necessary or desired and this step may be omitted. If coining or embossing are used to form the concave surface, the metal will preferably be in the "Condition A" (annealed) state for this operation. Other metal working techniques may be used with either annealed or hardened metal.

Following deformation, the metal sheet is subjected to standard heat treatment to place the sheet in a uniformly hardened condition, e.g., the RH950 condition for 17-7 stainless. This may be accomplished by heating annealed 17-7PH stainless steel to 1750° F., followed by a rapid quench to −100° F. for 8 hours and reheating to 950° F. for 1 hour. After cleaning the metal with standard cleaning solutions, such as alkaline types, and pre-etching acid, sheet 32 is coated with positive photoresist, preferably of a type described hereinabove, to a thickness of about 0.2 to 0.6 mils. The photoresist is indicated by stippled areas as at 34 in FIGS. 5 and 6 and in subsequent figures. Preferably, photoresist 34 is provided over the entire surface on both sides of sheet 32. However, less than the entire surface may be coated if desired, so long as those areas of the sheet are coated on which the image of the print-carrier element 10 or portions thereof are to be defined.

Following coating of sheet 32 on both sides, front and back, appropriate artwork comprising a mask or pattern (not shown) designed to provide an image in the photoresist is placed thereover. In this particular case, artwork patterns are placed over the front and the back surfaces of metal sheet 32, so as to register with each other and provide aligned front and back surface images of the carrier elements 10, or portions thereof, to be formed from both sides of the sheet. Upon exposure of the surfaces to radiation, such as high-intensity ultraviolet radiation, images resulting from the patterns used are formed, respectively, on both sides of metal sheet 32. Subsequent development of photoresist 34 with appropriate solvents removes that portion of the photoresist which has been exposed to the radiation, leaving unexposed areas of photoresist on the front (FIG. 5) and the back (FIG. 6) surfaces of sheet 32.

In this particular instance, the pattern used on the front surface (FIG. 5) is designed to protect areas of the photoresist corresponding to the first stage (slightly enlarged) type characters in circular arrangement in the concave area 30 and pads for the locator holes 50 from exposure as shown, and also the area of the sheet surrounding the characters, as shown at 34.

Figure 5:
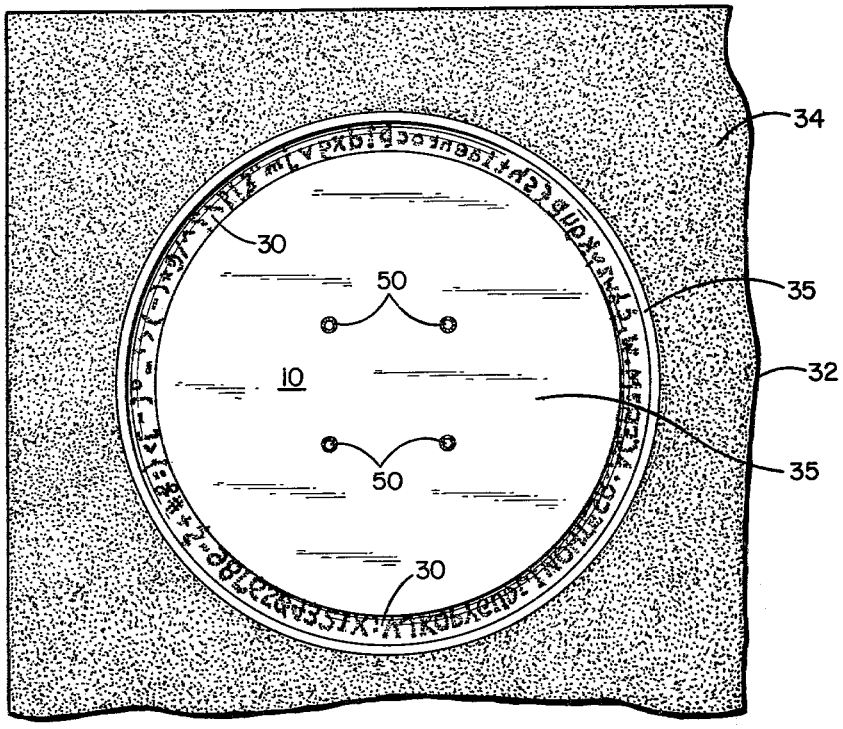
FIG. 5 is a top plan view (front face) of a sheet of metal stock coated with photoresist, selected portions thereof having been removed.

The remainder of the photoresist, corresponding to the clear areas 35, is exposed. Consequently, subsequent development removes the exposed photoresist, leaving the unexposed photoresist on the front face of the sheet stock as shown in FIG. 5, the areas indicated at 35 being areas of bare metal. In short, photoresist is removed from the surfaces of the metal sheet in those places where it is desired that etchant contact metal for effecting chemical milling.

Figure 6:
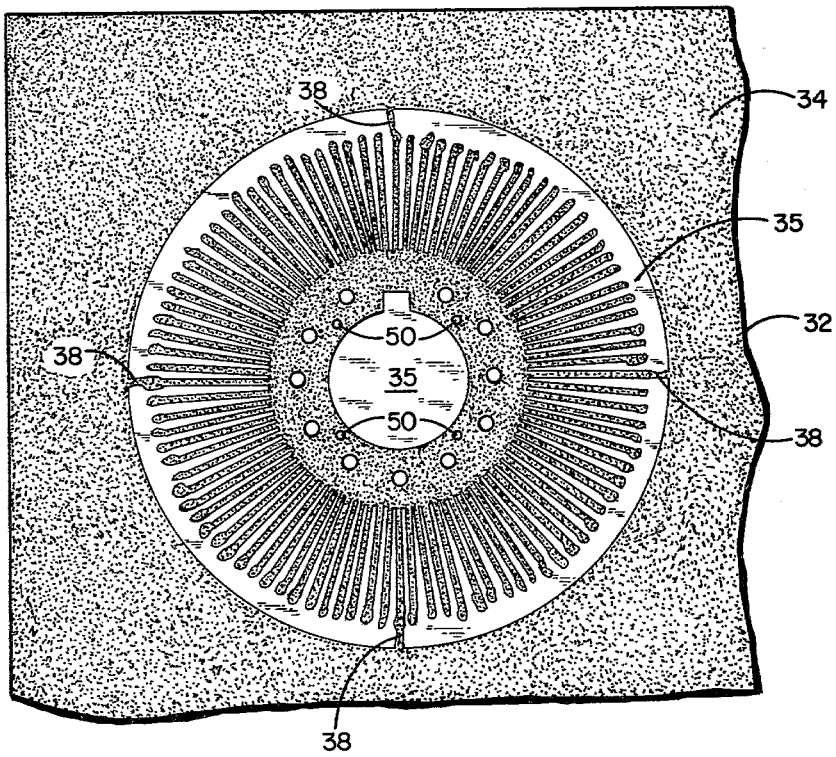
FIG. 6 is a bottom plan view (back face) of the metal stock in FIG. 5, selected portions of the photoresist having been removed.

It is to be noted in FIG. 5 that only the overall, somewhat enlarged, general shape and arrangement of the type characters and locating holes is defined by the remaining unexposed photoresist, i.e., first stage definition. Similarly, as shown in FIG. 6, the pattern used on the back surface is designed to protect areas of the photoresist corresponding to the overall outline shape of carrier element 10, from exposure to radiation as shown and also the balance of the surface area of the sheet. The remainder of the photoresist, corresponding to the clear areas 35, is exposed to radiation. Consequently, subsequent development removes the exposed photoresist on the back face of the sheet stock as shown in FIG. 6, the bared areas indicated at 35 becoming areas of bare metal stock. Also, selected attachment portions indicated at 38 may be retained to facilitate retention and handling of the carrier element during the remainder of the fabrication procedure. These portions also retain unexposed photoresist 34 as shown in FIG. 6.

As can be seen from FIGS. 5 and 6, only the first stage (slightly enlarged) characters and locator hole pads are printed on the metal stock on the front face (FIG. 5) with the outside shape of carrier element 10 defined only from the back (FIG. 6).

Figure 9:
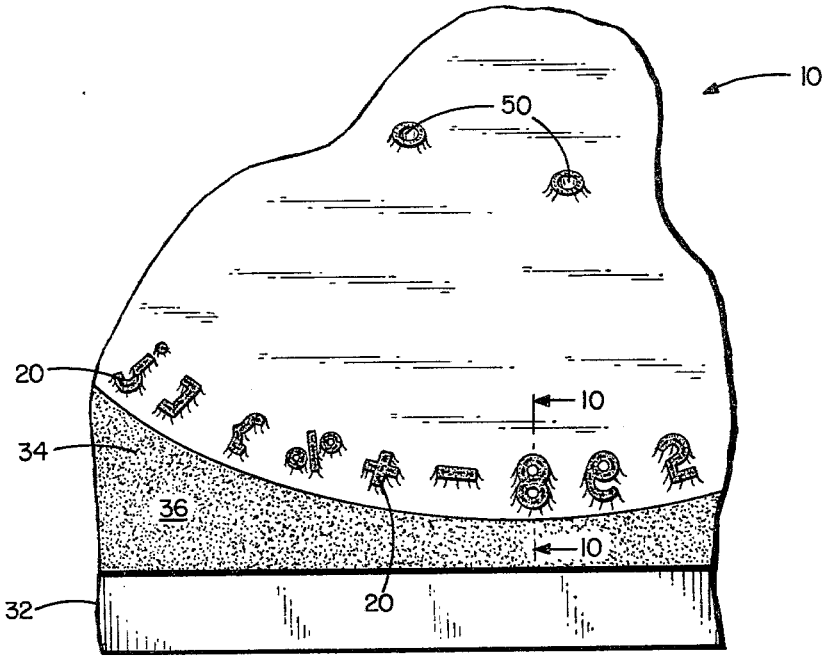
FIG. 9 is a fragmentary perspective view of the front face view of the metal sheet stock shown in FIG. 5 at a subsequent manufacturing stage.

At this time, the second stage (finely detailed) characters and locator holes are printed on the photoresist defining the first stage characters to provide latent character images therein as shown by dotted line in FIG. 9. They are merely printed and not developed at this stage. Also, care must be taken to avoid further exposure of the photoresist on back side at this stage to preserve the photoresist pattern shown in FIG. 6. However, a part number or other identifying data may be exposed on the back side if a shallowly-etched image is desired. Consequently, etching from the back will determine the overall shape of the carrier element and front etching will determine the thickness of the element, the shape of the type characters to be formed on the element, and the position and size of the locator holes.

Figure 7:
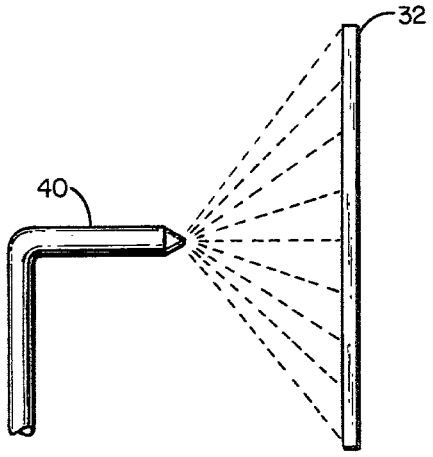
FIG. 7 schematically shows the etching technique utilized in exposing the metal sheet to etchant.

As schematically shown in FIG. 7, the metal sheet 32 in the fabrication stage shown in FIGS. 5 and 6 is then subjected to etching by exposure preferably to heated ferric chloride as by spraying an etchant out of a nozzle 40.

Figure 8:
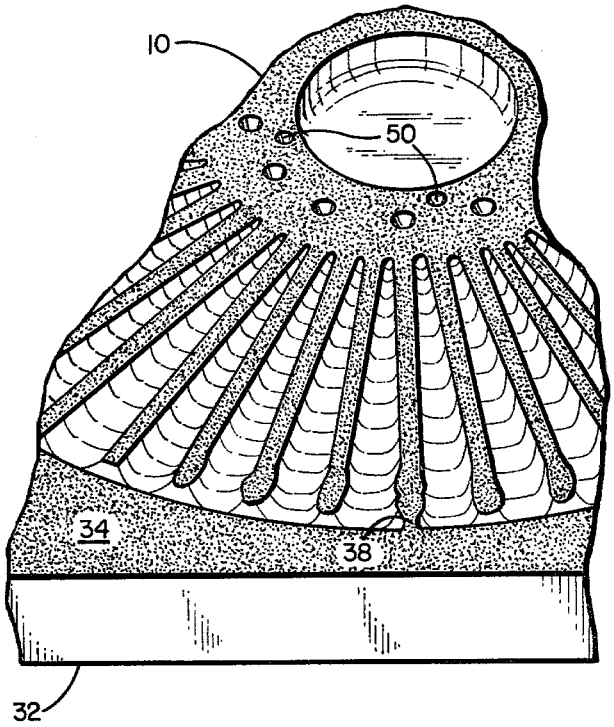
FIG. 8 is a fragmentary perspective view of the metal sheet stock back face shown in FIG. 6 following a preliminary etching step.

The back surface shown in FIG. 6 is preferably etched first, the front surface having been covered to prevent etchant contact with exposed surfaces thereof. Plastic tape is adequate for this purpose. In this particular instance, using 19 mil stock, preliminary etching is preferably allowed to occur until about 6 mils of exposed surface have been removed from the back side of the sheet. The results are shown in FIG. 8 with the element being partially etched from the sheet stock.

Figure 10:
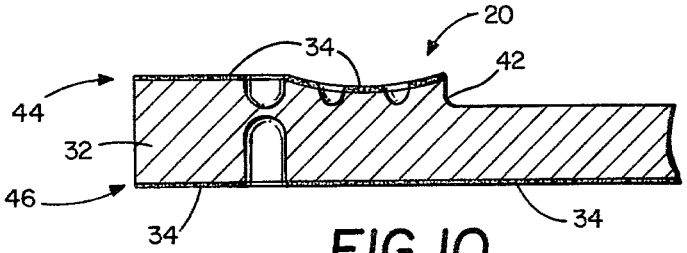
FIG. 10 is a fragmentary cross-section view taken along line 10—10 of FIG. 9.

Following the etching of the back surface, the front surface is uncovered and both the front and back surfaces are subjected to etching, either simultaneously or sequentially. Using 19 mil stock, 6 mils of exposed metal is removed from the front and an additional 6 mils is removed from the back. The results are shown for the front side in FIG. 9, showing the first stage (slightly enlarged) characters in relief on the partially etched surface. At this stage, the characters contain the latent images of the second stage characters. On the front surface, shown in FIGS. 9 and 10, the entire surface of carrier 10 will have been etched, except for the locating hole pads 50 and the first stage characters, causing a "bump" or a raised portion 42 to be formed in the general shape of the characters and locating hole pads. As can be seen in FIG. 10, carrier 10 is partially cut out of metal sheet 32 at this point, portions thereof having been removed from both the front top side 44 and back bottom side 46 thereof. Printing surface areas 20 still comprise first stage characters covered with photoresist which retains the latent images of the second stage print characters formed therein.

Figure 11:
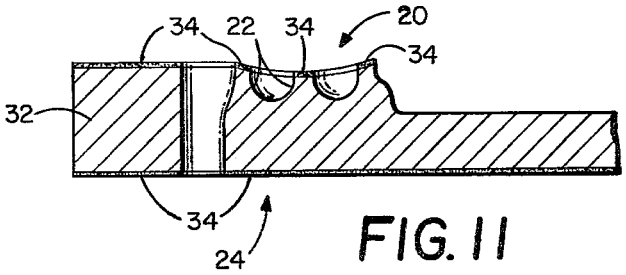
FIG. 11 is a fragmentary cross-section view of the type-carrier element arm portion shown in FIG. 10 at a near-final stage of manufacture.
Figure 12:
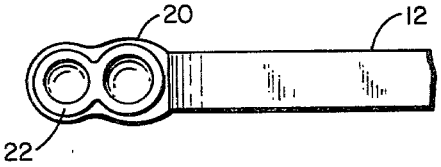
FIG. 12 is a top plan view of the type-carrier element arm of FIG. 11.
Figure 13:
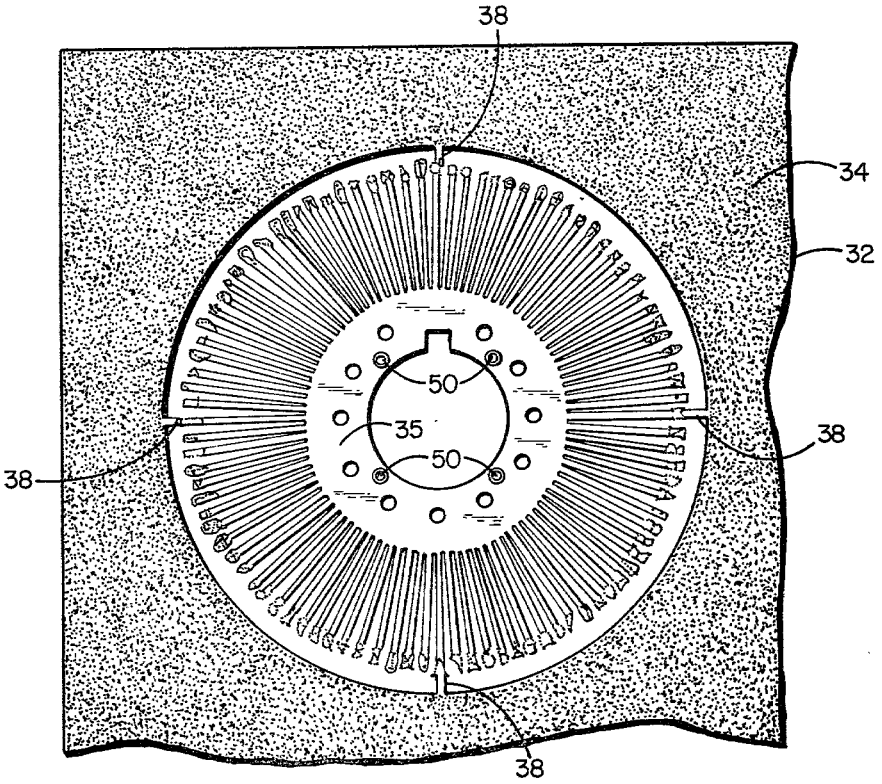
FIG. 13 is a front face view of the metal sheet stock shown in FIG. 5 after the etching is completed.

The second stage characters and locating holes are then developed on the front side of the sheet and both sides are subjected to additional etching. In this particular instance, both sides are etched an additional 3 mils. This causes the etchant to break through the sheet, defining the overall shape of the carrier element including the arms thereof as shown in FIGS. 11, 12 and 13. It also results in the formation of approximately 9 mil high characters and 10 mil thick arms.

It should be noted that the unitary carrier may be made with a variety of etching techniques. For example, in addition to spray etching, the dip tank technique or the agitated bath technique may be used. Standard commercially available equipment is readily available for any of these techniques.

Following etching, any remaining photoresist 34 is stripped away. For example, acetone may be used for stripping. The carrier element 10 is cleaned and freed from sheet 32. The final carrier structure may be treated to a final finishing etch to round off sharp edges. The so-called "cold dip" technique is satisfactory for this purpose, or an alternate electropolish bath may be used. This rounding and polishing will reduce the overall thickness to approximately the preferred 9 mils.

As previously indicated, carrier elements of configurations other than the planar disc-like configuration described above can also be made from one-piece metal by etching in accordance with this invention. For example, the barrel, or thimble configuration 52, shown in FIG. 14, may be made from a single piece of metal. It can be etched flat following which the arms may be bent upward to form the barrel-like sides thereof. Alternatively, a cylindrical piece of metal stock may be etched to form upwardly extending arms in situ.

Having described the invention by way of the above examples and general description, the subject matter in which exclusive rights are claimed is defined as follows:

1. The method of forming from metal stock a one-piece type-carrier element of the kind having a center portion and a plurality of arms extending therefrom, each arm having a printing surface and an oppositely disposed impact surface, the printing surface including integral print characters, comprising the steps:

coating both surfaces of the metal stock with photoresist material;

forming images defining the overall outline shape of the carrier element in the photoresist on one surface of the metal stock, hereinafter referred to as the impact surface thereof and defining first stage characters on the other surface of the metal stock, hereinafter referred to as the printing surface thereof, the images being in register;

removing photoresist to expose the metal stock except for that photoresist on the impact surface covering the carrier element shape and that photoresist on the print surface covering the first stage character shapes, and photoresist, if any, on both surfaces of the metal stock selected to facilitate handling during fabrication;

forming second stage character images defining selected print characters in the photoresist remaining on the printing surface first stage character areas without further exposure of the photoresist on the impact surface;

etching the exposed metal stock on the impact surface only to a predetermined depth;

etching the exposed metal to a predetermined depth on both the impact and the printing surfaces of the metal stock;

removing the remaining photoresist material from the printing surface except for that which defines the second stage print characters; and further etching the exposed metal on both the impact and printing surfaces until breakthrough occurs whereby the element and the print characters thereon are formed and any remaining metal stock immediately adjacent the element is completely removed except for any portions selected to facilitate handling.

2. The method of claim 1 in which the photoresist is of the positive type.

3. The method of claim 1 in which locating hole images are formed simultaneously with the formation of the first and second stage character images by means of a single integrated pattern therefor, thus assuring registration of the locating holes with the characters.

4. The method of any preceding claims 1, 2 or 3 in which image formation is by means of exposure of selected portions of the photoresist material to radiation and the removal of selected areas of photoresist is by selective solvent removal.

5. The method of any of the preceding claims 1, 2 or 3 in which the metal stock is precipitation hardened steel.

6. The method of any of the preceding claims 1, 2 or 3 in which the steps thereof are preceded by a step to form a ring-like concave printing surface area in the metal stock.

7. The method of claim 1 in which the steps thereof are preceded by a coining step to form the concave area.

8. The method of claim 1 in which the steps thereof are preceded by a machining step to form the concave area.

9. The method of claim 7 in which the material is in the annealed condition when the concave area is formed and the material is thereafter subjected to a precipitation hardening treatment prior to the steps set forth therein.

* * * * *

UNITED STATES PATENT AND TRADEMARK OFFICE

CERTIFICATE OF CORRECTION

PATENT NO. : 4,251,318

DATED : February 17, 1981

INVENTOR(S) : Gary Oberg, et al

It is certified that error appears in the above-identified patent and that said Letters Patent are hereby corrected as shown below:

Column 3, line 14, "FIG. 6 is a bottom plan" should be the beginning of a new paragraph.

Column 5, line 31, "177PH" should be --17-7PH--.

Column 5, line 47, "(2300)" should be --2300--.

Column 5, line 49, "(02162)" should be --02162--.

Signed and Sealed this

*Twenty-first* Day of *April 1981*

[SEAL]

*Attest:*

RENE D. TEGTMEYER

*Attesting Officer*

*Acting Commissioner of Patents and Trademarks*